US009714554B1

(12) United States Patent
Cook et al.

(10) Patent No.: US 9,714,554 B1
(45) Date of Patent: Jul. 25, 2017

(54) PARTIALLY REMOVABLE RELEASABLE PLUG AND METHOD

(71) Applicants: Robert B. Cook, Mandeville, LA (US); Glenn M. Walls, Madisonville, LA (US)

(72) Inventors: Robert B. Cook, Mandeville, LA (US); Glenn M. Walls, Madisonville, LA (US)

( * ) Notice: Subject to any disclaimer, the term of this patent is extended or adjusted under 35 U.S.C. 154(b) by 36 days.

(21) Appl. No.: 14/860,148

(22) Filed: Sep. 21, 2015

Related U.S. Application Data

(60) Provisional application No. 62/053,482, filed on Sep. 22, 2014.

(51) Int. Cl.
*E21B 23/06* (2006.01)
*E21B 33/129* (2006.01)

(52) U.S. Cl.
CPC ..... *E21B 33/1291* (2013.01); *E21B 23/06* (2013.01)

(58) Field of Classification Search
CPC ..... E21B 23/06; E21B 33/1291
See application file for complete search history.

(56) References Cited

U.S. PATENT DOCUMENTS 4,432,418 A * 2/1984 Mayland ..... E21B 23/06 166/123
4,436,150 A * 3/1984 Barker ..... E21B 33/134 166/123
4,572,289 A * 2/1986 Rosenthal ..... E21B 33/1293 166/123
6,220,348 B1 * 4/2001 Serafin ..... E21B 31/03 166/133
7,743,838 B2 6/2010 Wilson
9,121,254 B2 * 9/2015 Gregory ..... E21B 33/134
2010/0084140 A1 * 4/2010 Hern ..... E21B 7/061 166/377
2014/0196913 A1 * 7/2014 Pedersen ..... E21B 33/134 166/386

FOREIGN PATENT DOCUMENTS

GB 2308138 A * 6/1997 ..... E21B 23/01

* cited by examiner

*Primary Examiner* — Matthew R Buck
(74) *Attorney, Agent, or Firm* — Jones Walker LLP

(57) ABSTRACT

A downhole plug and a method of releasing a portion of the plug. The plug has a run-in configuration, a deployed configuration, and a released configuration. The plug includes a mandrel, a bull nose, and a cone and an expandable slip. The expandable slip has an external gripping surface. The plug includes an inner and outer sleeve, where the outer sleeve is concentric around the inner sleeve and the inner sleeve is concentric with the mandrel. The inner sleeve is slidable about but releasingly coupled to the mandrel. The inner sleeve is slidable about the outer sleeve but releasingly coupled to the outer sleeve in both the run-in configuration and in the deployed configuration. The inner sleeve is coupled with the mandrel in the run-in configuration and in the deployed configuration, but uncoupled and slidable about the mandrel in the released configuration.

24 Claims, 5 Drawing Sheets

PARTIALLY REMOVABLE RELEASABLE PLUG AND METHOD

CROSS-REFERENCE TO RELATED APPLICATIONS

This application claims priority to U.S. Provisional Application No. 62/053,482, filed on Sep. 22, 2014, and which is hereby incorporated by reference in its entirety.

BACKGROUND OF THE INVENTION

This invention relates to a downhole apparatus and method, including a packer or plug apparatus. More particularly, but not by way of limitation, this invention relates to an apparatus for a well packing device that can be partially removed downhole.

Generally in the prior art, well bore packing devices or plug devices use slip assemblies as a means to anchor the packing device to the tubular member of the well to be sealed off. The slip assemblies anchor the device within the well bore. Examples of prior-art packing devices are shown in U.S. Pat. No. 7,743,836, which is incorporated herein by reference in its entirety. Packers/plugs can be used for a variety of purposes, including placing a plug downhole in a "plug and abandon" procedure. One typical type of plug is called a cast iron bridge plug (CIBP), which is generally a tool that operates to seal against the well bore and is not designed to be retrievable or releasable from a set position. The CIBP is intended to be permanently positioned in the well bore at a desired location. Typical CIBPs are constructed of soft metal alloys, including high carbon steel, and also of composite synthetic materials. The running diameter of the plugs/packers are within close tolerances with the tubular for which it is designed to set and seal. This is necessary for the plug to be able to hold high differential pressures during the life cycle of the plug. This close tolerance can present problems in a well due to the presence of bends in the well tubing/casing or the presence of scale or other foreign matter that would serve to restrict the inner diameter of the well bore. In these instances, the plug can become lodged in the tubular during run-in at an unintended location and require removal.

Removal is accomplished via milling or drilling using a rig, snubbing unit, or coiled tubing unit. The removal process is time consuming and expensive, as the body of the plug contains a substantial amount of metal that must be drilled out. Some vendors have created plugs made from composite materials to reduce the time required to mill and remove the plug when compared to the metal alloy plugs.

As used herein:

i) The term plug refers to both packers (which allow flow through a center channel or bore of the packer) and plugs (which generally completely seal a tubular)

ii) The term "upward" refers to a direction toward the top of the well bore (the surface);

iii) The term "downward" refers to a direction toward the bottom of the well bore;

iv) The term "well bore" refers to an open hole, a cased well bore, or a well bore with a liner or tubing.

SUMMARY OF THE INVENTION

A downhole plug is provided that has a run-in configuration, a deployed configuration, and a released configuration. The plug includes a mandrel, a bull nose having an upwardly facing bearing surface, a cone and an expandable slip. The cone and slip are concentrically positioned around the mandrel. The cone is positioned adjacent to the slip. The expandable slip has an internal surface and an external surface. The external surface contains a gripping surface. The cone has a shaped engagement surface for engaging the expandable slip internal surface. When the plug is in the deployed configuration, the slip is expanded. The plug includes an inner sleeve and an outer sleeve. The outer sleeve is positioned concentrically around the inner sleeve. The inner sleeve is positioned concentrically around the mandrel. The inner sleeve is slidable about the mandrel but releasingly coupled to the mandrel. The inner sleeve is slidable about the outer sleeve but releasingly coupled to the outer sleeve in both the run-in configuration, the deployed configuration, and the released configuration. The inner sleeve is engaged with the mandrel in the run-in configuration and deployed configuration. The inner sleeve is released from the mandrel and slidable about the mandrel in the released configuration. An elastomeric member is disposed about the mandrel between the outer sleeve and the bull nose.

In an embodiment of the plug, the internal surface of the slip has a tapered portion.

In an embodiment of the plug, the mandrel and the bull nose have a hollow center bore.

In an embodiment of the plug, the plug includes a ratcheting mechanism including a lock ring that releasingly engages with a series of ridges positioned on either the inner sleeve or the outer sleeve.

In an embodiment of the plug, the inner sleeve is releasingly engaged with the mandrel with a shearable pin or screw.

In an embodiment of the plug, the mandrel and bull nose are integrally formed.

In an embodiment of the plug, the lock ring comprises a slotted cylinder.

In an embodiment of the plug, the lock ring includes a series of independent curved segments.

A method of releasing a portion of a plug that is engaged with a well bore. The plug includes a mandrel, a bull nose having an upwardly facing bearing surface, and a slip concentrically positioned around the mandrel. The slip has an external surface. The external surface contains a gripping surface. The griping surface engages a first interior portion of the well bore. The plug includes an inner sleeve and an outer sleeve. The outer sleeve is positioned concentrically around the inner sleeve and the inner sleeve is positioned concentrically about the mandrel. The inner sleeve is slidable about the mandrel but releasingly engaged to the mandrel. The outer sleeve is slidable but releasingly engaged with the inner sleeve at a first position on the inner sleeve. An elastomeric member is positioned concentrically about the mandrel between the outer sleeve and the bearing surface. The elastomeric member engages a second interior portion of the well bore.

The method includes the steps of positioning a tool adjacent to either the mandrel or the inner sleeve, and apply force to the mandrel or the inner sleeve with the tool, whereby the inner sleeve releases from engagement with the mandrel, but the inner sleeve remains engaged with the outer sleeve.

An embodiment of the method includes the steps of coupling the tool to the inner sleeve and applying an upward force to the inner sleeve with a tool.

An embodiment of the method includes the steps of applying a first downward force to the mandrel with a tool.

An embodiment of the method includes the steps of removing the engaged inner and outer sleeves from the mandrel.

An embodiment of the method includes the steps of waiting a period of time, after the application of a first downward force, whereby the elastomeric member disengages with the wall of the well bore, and applying a second downward force to either the mandrel, inner sleeve or outer sleeve, whereby the plug descends in the well bore.

An embodiment of the method includes the step of waiting a period of time, after the application of the upward force to the inner sleeve, whereby the elastomeric member disengages with the wall of the well bore, and applying a downward force to the mandrel.

An embodiment of the method includes the steps of milling or drilling the remaining portion of the plug in the well bore after removal of the inner sleeve and outer sleeve.

An embodiment of the method includes a plug wherein the inner sleeve and mandrel are releasingly engaged with a pin or screw.

An embodiment of the method includes a plug wherein the inner and outer sleeve are releasing engaged by a lock ring.

An embodiment of the method includes a lock ring that includes a threadable segment that is positioned between the inner and outer sleeve.

An embodiment of the method includes a plug having a lock ring that comprises a series of threadable segments.

In an alternative embodiment, the plug has a mandrel, a bull nose having an upwardly facing bearing surface, and an expandable slip concentrically positioned around the mandrel. The expandable slip has an internal surface and an external surface. The external surface contains a gripping surface. When the plug is in the deployed position, the slip is expanded. When the plug is in the run-in configuration, the slip is not expanded. The plug also includes an inner sleeve and an outer sleeve. The outer sleeve is positioned concentrically around the inner sleeve and the inner sleeve is positioned concentrically around the mandrel. The inner sleeve is slidable about the mandrel but releasingly coupled to the mandrel. The inner sleeve is slidable about the outer sleeve but releasingly coupled to the outer sleeve in both the run-in configuration and the deployed configuration. The inner sleeve is engaged with the mandrel in the run-in configuration and deployed configuration. The inner sleeve is released from the mandrel and slidable about the mandrel in the released configuration. An elastomeric member is disposed about the mandrel between the outer sleeve and the bull nose.

In an embodiment of the plug, the plug includes a pin or screw releasingly coupling the inner sleeve and outer sleeve, whereby in the deployed and released configuration, the pin or screw has failed.

In an embodiment of the plug, the plug includes a lock ring positioned between the inner and outer sleeves. The lock ring releasingly couples the inner and outer sleeve in the run-in, deployed, and released configurations.

DETAILED DESCRIPTION OF THE INVENTION

Figure 1:
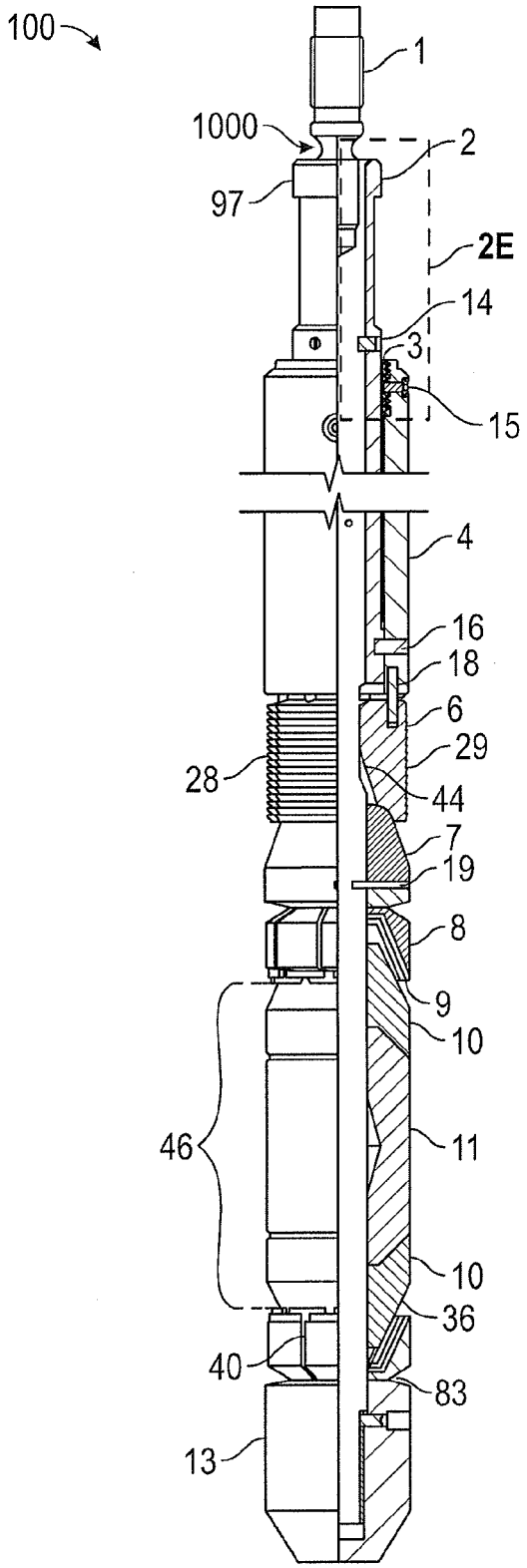
FIG. 1 is a cross section through one embodiment of the tool
Figure 2A:
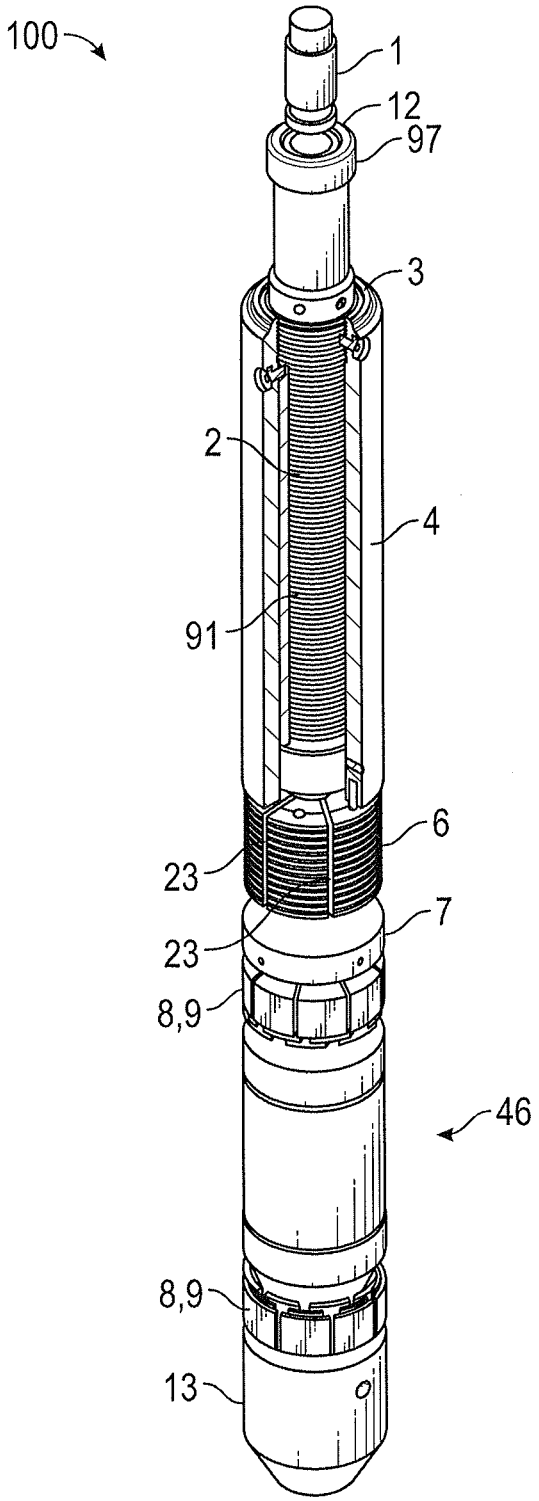
FIG. 2A is a partial cutaway view the embodiment of FIG. 1.
Figure 2B:
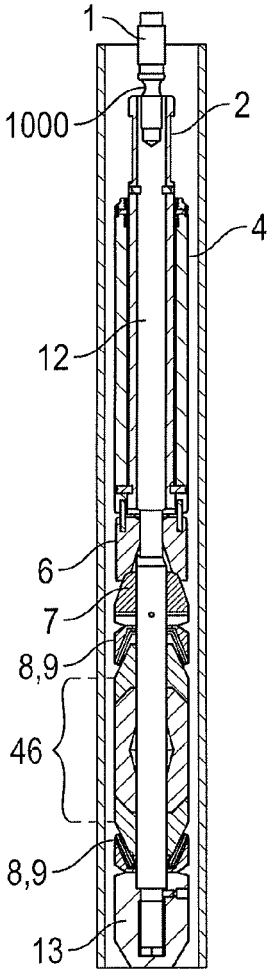
FIG. 2B is a cross section through the tool of FIG. 1 in the run-in configuration.

The tool of the present invention will be described as one embodiment of a cast iron bridge tool (CIBP). However, the invention is not so limited, and embraces plugs, and packers and other well tubular sealing devices, including cement retainers. Referring now to FIGS. 1, 2A, and 2B, a preferred embodiment of the present invention in the run-in mode or configuration will now be described. More specifically, the apparatus or tool 100 is shown disposed within a well 400, and wherein the well 400 includes a casing string or a tubular string. The well 400 has an inner diameter portion 406. The tool as described may also be used in open, uncased holes. As those of ordinary skill in the art will recognize, the apparatus 100 is operatively associated with a setting tool 2000 (see FIG. 3) for setting the apparatus 100. Setting tool 2000 may be hydraulically activated, mechanically activated, explosively activated, or electrically activated.

The setting tool 2000 is operatively attached to the tool 100 (see FIG. 3) (hereafter referenced as a CIBP). In one embodiment, the setting tool 2000 is threadably attached to the tension stud 1 of the CIBP 100. The setting tool 2000 may be internally or externally threadably attachable to the CIBP 100. In other embodiments, the setting tool 2000 may latch onto the CIBP 100, such as onto the tension stud 1, or be pinned to the CIBP 100 (such as pinned to a hollow mandrel) or otherwise coupled to the CIBP 100.

In one embodiment, tool mandrel 12 terminates at the top in an externally threaded tension stud 1 that threads into the mandrel 12. Tension stud 1 has a narrowed neck section 1000, shown positioned above top of the inner sleeve 2 and outer sleeve 4, when the tool is in the run-in configuration of FIG. 2B (the neck location can vary). The mandrel 12 terminates at the bottom with a bull nose 13 that is coupled to the mandrel 12. Bull nose 13 may be integral with or attached to the central mandrel 12. In the embodiment shown in FIG. 1, the mandrel 12 is a single elongated member, but may be composed of multiple sections joined together (e.g., threaded, set screws, etc.).

Mandrel 12 generally has a smooth outer surface about which inner sleeve 2 is slidably disposed. The top of inner sleeve 2 has a flange 97 which can be used as a latching surface for removal as later described. Mandrel 12 contains radial slots or thread openings that align with openings through the inner sleeve 2 for pins or screws 14 to pin, couple, or engage the inner sleeve 2 to the mandrel 12. That is, on run-in, the mandrel 12 is coupled to inner sleeve 2 and they effectively move as a unit. However, the inner sleeve 2 is releasingly engaged to the mandrel 12. With sufficient axial orientated forces, the pins 14 will fail allowing separation of the inner sleeve 2 from mandrel 12. As used, "engaged" or coupled means that one member is coupled or engaged to the other (substantially fixed in position) until released, in which event the two members are free to move with respect to the other at the coupled location (unless restrained by engagement at another location) until they re-engage or recouple (if possible). The number of slots/pins, the thickness of the pins, the type of material of the pins, can vary based on the desired forces to shear the pins and separate the coupled members.

Other releasable coupling devices could be used in lieu of pins, such as springs, collets, ball/recesses and other engaging means that can be released, as is well known in the art. The outer sleeve 4 is concentrically disposed about the inner sleeve 2. On run-in, the outer sleeve 4 is coupled to the inner sleeve 2, such as by shearable pins or screws 16 positioned in aligned openings between the outer sleeve 4 and inner sleeve 2. While the inner sleeve 2 and outer sleeve 4 are also releasingly coupled or engaged by a ratcheting type of mechanism (later described), the use of pins 16 are preferred to finely control the release forces and prevent premature stroking (setting) of the tool.

In one embodiment, the exterior surface of the inner sleeve 2 has a series of annular grooves, rings, ridges, or threads 91. In the embodiment shown, the interior surface of outer sleeve 4 is preferably a smooth bore. The bottom end of the outer sleeve 4 also preferably has longitudinal slots that align with longitudinal slots in the slips 6. Pins 18 or screws preferably are positioned in the aligned longitudinal slots, but are not required. Preferably the bottom of the outer sleeve 4 has a curvature or radiused portion to assist in rocking or expansion of the slips 6 during deployment (later described) but this also is not required. See FIGS. 2A, 2B, 2C.

The tool shown has a single slip 6. The slip 6 is generally a cylindrical member that is concentrically disposed about the mandrel 12. The slip 6 preferably has a series of longitudinal grooves, slots, or cuts 23 disposed partially or completely through the cylindrical wall so that when the slip 6 expands, the slip 6 will fracture or separate in a controlled manner along slots 23 into separate and usually equivalent segments. The slip 6 has an outer cylindrical surface 28 that may be tapered (such as shown in U.S. Pat. No. 7,578,353) or not (such as shown in FIG. 2A). The outer surface 28 contains a plurality of radial teeth or ridges 29, or other surface alterations, to form a gripping surface for engagement with the inner diameter portion 406 of the tubing or casing or well bore 400. Preferably, the teeth 29 are upwardly facing (e.g. the top of each tooth is larger in diameter that the bottom of each tooth as shown in FIG. 1), but may also be downwardly facing for different applications (or have a series of both upward and downward facing ridges). The inner surface of the slip 6 preferably has a portion that is tapered or angled or curved 44 to accommodate and contact with cone 7 when a cone is used for deployment. Some slips have no taper on the inner surface. Additionally, some slip devices may be hingedly deployable and spring loaded for release when a spring member is released, and may not use a cone for deployment.

Cone 7 preferably forms a tapered cylinder where the taper thins in the region of the slip 6 for cooperation with the angled surface 44 of the slip device 6. Other shaped surfaces can be used for the cone 7 to interface the inner or internal surface of the slip 6 and expand the slip during deployment. As shown, the cone 7 preferably is pinned to the mandrel 12 with pins 19, but the cone 7 may be free on the mandrel 12, or may be integrally formed in the elastomeric member 46 (not shown). FIG. 2B also depicts the elastomeric member 46, sometimes referred to as the elastomer means, which in operation will be compressed, causing the member to expand radially in order to engage and seal with the inner diameter portion 406 of the well or tubing. The elastomeric member 46 shown is a three component member: a top member 10, middle member 11, and bottom member 10. The top and bottom members 10 are generally elastomeric but of higher durometer than the middle member 11. Typical compounds include NBR, HNBR, Viton, Aflas.

The top and bottom members 10 interact with the cups 8 and 9 to compress and expand the elastomeric middle member 11 into a sealing position in a controlled fashion. The elastomeric member 46 may be also be a single member. FIG. 2B shows an upper series of cups 8 and 9 (sometimes referred to as petals), and a lower series of cups 8 and 9 that cooperate and engage with opposing ends of the elastomeric member 46. More specifically, FIG. 1 depicts the cups 8, 9 as nested. As shown, cup 8 is a series of cups. The cups preferably are composed of deformable metal alloy and have longitudinal slots 40 cut in the wall of the cups. The cups 8, 9 are designed to expand or open outwardly (much like a petal opening) along slots 40 when compressed against the tapered end region 36 of the elastomeric member 46. The opened cups act to control and guide the expansion of the elastomeric member 46 and act as a "stop" to prevent the elastomeric member 46 from "flowing" up or down the well bore during radial expansion of the elastomeric member. The use of upper and lower cups (or cup) are preferred as it helps guide the elastomer member when deploying, but they are not required. In some embodiments, the top and bottom portions 10 of the elastomeric member may include a metal mesh to resist upward or downward deformation of the elastomeric member 46.

Attached to the bottom of the mandrel 12 is bull nose 13. Bull nose 13 has an upward facing bearing surface 83 against which one side of the elastomeric member 10 (or cups if present) will operationally bear against during deployment of the tool (e.g. axial or longitudinal compression of the elastomeric member) (there may be intermediary members between the bearing surface 83 and the elastomeric member, such as a lower slip, lower cone, cups etc, and in this situation, the elastomeric member is still considered to be adjacent to the bearing surface).

As shown, the tool uses a single upper slip 6. Dual slips (e.g., an upper and lower slip device such as shown in U.S. Pat. No. 7,743,836) could be used, but are not preferred. Also, instead of a single upper slip, a single lower slip 6 could be used, such as a lower slip 6 and a lower cone 7.

Figure 2C:
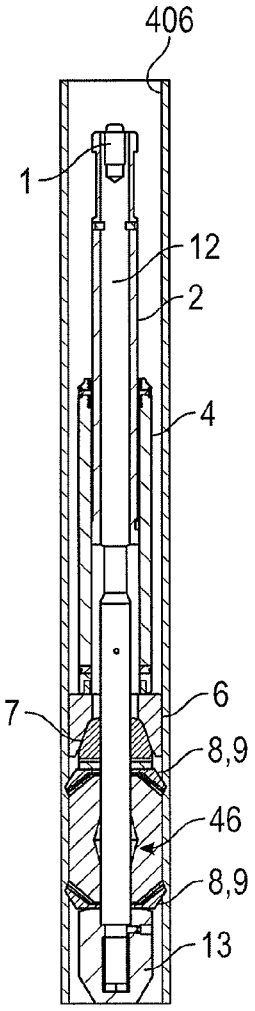
FIG. 2C is a cross section through the tool of FIG. 1 in a set or deployed configuration.
Figure 2D:
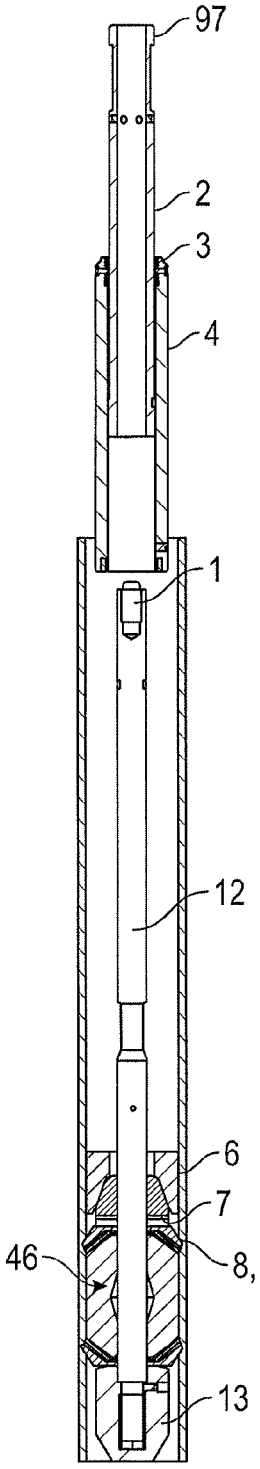
FIG. 2D is a cross section of the tool of FIG. 1 in a released configuration.
Figure 2E:
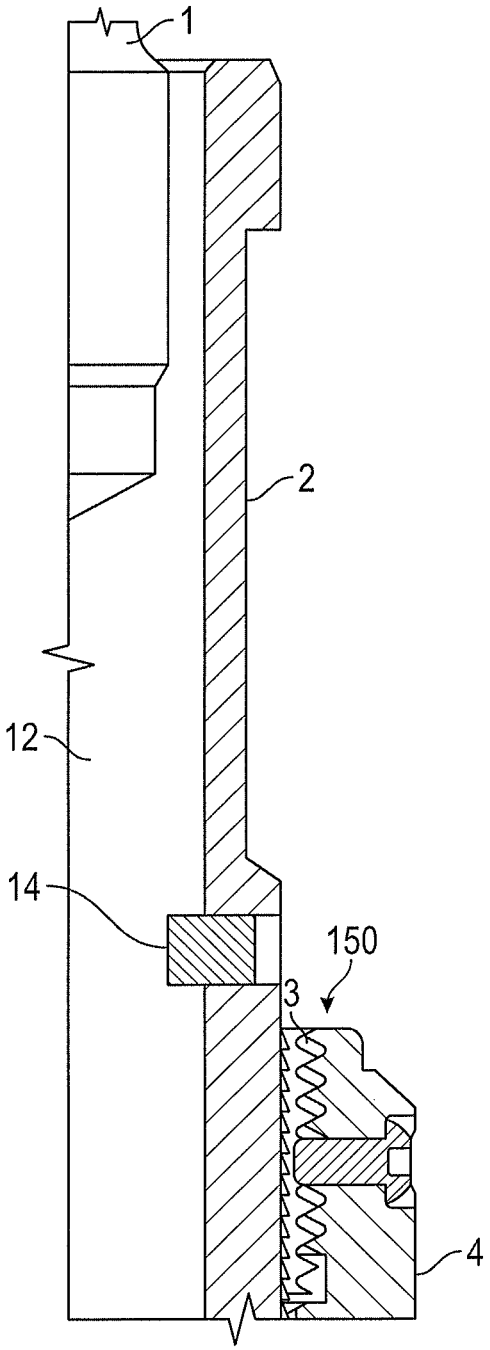
FIG. 2E is a detail view showing one embodiment of a lock ring.

FIG. 2E is a detail showing one embodiment of a ratcheting mechanism for the tool. As shown, the top portion of the interior of the outer sleeve 4 has recessed region 150. The preferred recessed region 150 is a threaded or ridged region. As used herein, threads, ridges grooves and raised rings are used interchangeably. Positioned in this threaded region 150 is a lock ring 3. One embodiment of a lock ring 3 is a slotted sleeve (such as single split ring) or a collet. In the embodiment shown, the lock ring 3 has both external radial threads or ridges and internal radial threads or ridges. The external threads or ridges on the exterior surface are cut to engage the threaded or ridged region of the recess 150 and maintain the lock ring 3 in the recess, but has enough play to allow the lock ring 3 to expand radially. Alternatively, the recess may be non-threaded, for instance, and have an engageable top cap to retain the lock ring 3 in the recess 150. The interior facing threads or ridges on the lock ring 3 are designed to interface with the ridges or threads 91 on the exterior of the inner sleeve 2 as a ratchet type of mechanism for one way movement. For instance, the lock ring 3 may be a collet with multiple fingers that has a single interior ridge at the end of the fingers, or be ridged on the majority of the finger areas, for interaction with ridges or threads on inner sleeve 2. The interior facing threads of lock ring 3 may be cut different from the exterior threads (if present) to allow a "lock and release" interface action with the inner sleeve threads 91 caused by engagement and disengagement interaction of the lock ring 3 with the threads or ridges 91 of the inner sleeve 2. In this fashion, downward ratcheting type of motion is allowed between the inner sleeve 2 and outer sleeve 4, but the lock ring 3 resists relative upward motion. Similarly, the ridges on inner sleeve 2 may be cut differently from those on lock ring 3.

The slot of the lock ring 3 allows the lock ring 3 to radially expand and contract within the recess 150 in a spring type of action to provide for the engagement and disengagement interaction of the lock ring 3 with the threads or ridges 91 of the inner sleeve 2. Instead of a slotted ring or collet, a series of separate threaded or ridged segments could be used as the lock ring 3. In this instance, it is preferred that the recess 150 be tapered and the exterior face (facing the recess) is correspondingly tapered. The tapered region results in a wedging type of action by the segments of the lock ring 3 against the inner sleeve 2, preventing upward movement of the outer sleeve 4. Also shown is screw 15, with the screw preferably engaging a slot in the lock ring 3, to restrict rotation of the lock ring 3 in the recess 150. Instead of a screw, a cap or other device may be used to resist rotation of the lock ring 3.

Referring now to FIG. 2B, the embodiment of the present tool 100 is shown in the run-in mode (non-deployed mode), where the embodiment contains a single upper slip 6. It should be noted that like numbers appearing in the various figures refer to like components. To deploy the embodiment of FIG. 2A, the setting tool 2000 threads onto the tension stud 1, and the CIBP 100 is positioned in the well bore adjacent to the location where deployment is desired. To deploy, the setting tool 2000 "pulls" up on the tension stud 1 while an outer sleeve or cylinder of the setting tool 2000 "bears" down on the top of the outer sleeve 4. Initially, the mandrel 12, inner 2, and outer sleeve 4 are all coupled or engaged together, such as with pins or screws. With enough applied differential force (e.g, the difference between the up pull and downward bearing axial forces), the screws or pins 16 connecting the inner sleeve 2 to the outer sleeve 4 fail releasing or disengaging the inner sleeve 2 from the outer sleeve 4. The applied forces then cause the mandrel 12 and coupled inner sleeve 2 to move upwardly with respect to the outer sleeve 4 (or contra wise, the outer sleeve 4 to move downwardly with respect to the mandrel 12 and coupled inner sleeve 2).

The relative downward movement of the outer sleeve 4 is initially resisted by engagement of the lock ring 3 threads with the threads or ridges 91 on the inner surface of inner sleeve 2. With sufficient applied force, the lock ring 3 will expand (via expansion of the slot in the lock ring) and release and disengage from the ridges of inner sleeve 2, allowing the outer sleeve 4 to move downwardly (or mandrel 12/inner sleeve 2 move upwardly). The outer sleeve 4 descends until the lock ring 3 springs back and constricts and re-engages the threads or ridges 91 on the inner sleeve 2. In reengaging, the lock ring 3 "locks" or restrains the outer sleeve 4 from motion (particularly from upward motion). The engagement/disengagement action of lock ring 3 allows the outer sleeve 4 to descend (with respect to the coupled mandrel/inner sleeve) by a ratcheting type of step action with applied axial force, but resists upward movement of the outer sleeve 4 with respect to the inner sleeve 2.

Downward movement of the outer sleeve 4 (or upper movement of the mandrel) affected by the setting tool 2000, causes the slip 6 to move downwardly contacting the upper cone 7. Additional downward movement of the outer sleeve 4 (via ratchet step action) will eventually exert sufficient force to cause pins 19 to fail (if present) allowing the upper cone 7 to move downwardly with the outer sleeve 4. Forces are now exerted on the elastomeric member 46 which is trapped between the opposing cups 8, 9 and the bearing surface 83 of the bull nose 13. As additional downward forces are applied, the cups 8, 9 will begin to deform and the elastomeric member 46 will begin to compress and expand radially, with expansion continuing with applied forces until sufficient contact is made with the casing or tube wall 406 to form a gripping seal. At this point, the elastomeric member 46 is engaged with the wall and additional applied forces now are transferred to the slip 6, further opening or expanding the slip 6. In some cases, the slips may partially expand concurrently as the elastomeric member expands.

With the slip 6 sufficiently opened (deforming along the slots 29), the alignment pins 18 (if present) deform, until these pins 18 fail, releasing the slip 6 from the outer cylinder 4. Additional applied differential forces will generally cause the slip 6 to split into components, expand and fully open and engage the interior wall 406 of the well bore 406. "Expansion" of the slip 6, or an expandable slip, means the slip 6 moves from a position adjacent the mandrel 12 to a position distal from the mandrel 12. The slip may be several independent pieces which form a cylinder or partial cylinder, that consequently "expands" during deployment.

Once the elastomeric member 46 and slip 6 are fully engaged, continued action of the setting tool 2000 cannot further move the outer sleeve 4, and the additional applied forces begin to stretch the tension stud 1 at the thinned neck region 1000, until the neck region 1000 fails (such as by tensile failure), freeing the setting tool from the CIBP.

When the setting tool 2000 is released and the applied forces are removed, the position of the outer sleeve 4 with respect to the inner sleeve 2 remains fixed due to interaction of the lock ring 3 with the inner sleeve's threads 91. The lock ring 3 thus "locks" the position of the outer sleeve 4 with respect to the inner sleeve 2, effectively "locking" in the tension in the mandrel 12 and the compressive forces that maintains the slips 6 and elastomeric member 46 engaged with the wall 406. The CIBP is now installed in position, or in a deployed configuration, as shown in FIG. 2C.

If the tool 100 later needs to be removed, a pulling tool is then positioned down the well, and the pulling tool will latch onto the top flange 97 on the inner sleeve 2, for instance. An upward force is applied until the screws or pins 14 between the inner sleeve 2 and mandrel 12 fail, freeing the inner sleeve 2 from the mandrel 12. Continued upward force allows the coupled inner/outer sleeve (coupled by the lock ring 3) to slide over the mandrel 12, until both sleeves totally disengage from the mandrel 12 (see FIG. 2D, showing the released configuration). By removing the inner sleeve 2 and outer sleeve 4 from the device, two benefits are obtained: (a) the tension and compression forces that kept the elastomeric member 46 and slips 6 engaged with the wall 406 has been removed; and (b) a large part of the metal components of the CIBP have been removed (e.g. inner/outer sleeves). With the applied forces released, the elastomeric member 46 will contract and longitudinally expand, and the slip 6 should loosen. The portion of the CIBP 100 left in the well bore likely will then release and fall to the bottom of the well. If not, to remove the remaining tool 100 in the well bore, a push force can be applied to the mandrel 12 with a tool (such as a wireline blind box, or the pulling tool), and the remaining device may then release and fall to the bottom of the hole. Alternatively, the remaining portion of the device 100 may be drilled or milled out. With much of the tool's original metal portions removed (e.g. inner/outer sleeves), the milling procedure will be less time consuming and hence less expensive.

As described above, the axial longitudinal forces needed to separate the inner sleeve 2 from mandrel 12 are greater than those needed to separate the inner sleeve 2 from the outer sleeve 4, and are applied by a pulling tool attached to the inner sleeve 2. Alternatively, a tool to push down on the mandrel 12 (if the mandrel extends above the inner sleeve 2) could be deployed to "jar" down on the mandrel 12 again resulting in the failure of pins 14, separating the inner sleeve 2 from the mandrel 12, thereby releasing the trapped forces and allowing the entire tool to fall.

The above describes the procedure to remove the CIBP 100 after it has been set. If the CIBP 100 gets jammed in the run-in, the removal procedure is similar. First, it is recommended that the jammed tool be actuated, set or deployed, then either a pulling tool or pushing tool is attached to the inner sleeve or mandrel and forces applied to separate or break the coupling between the mandrel 12 and inner sleeve 2, allowing the inner/outer sleeve to be separated from the mandrel and/or be removed from the CIBP 100. The remaining portion of the CIBP 100 is milled or drilled out or pushed to bottom of the bore. While deploying the tool is preferred, it is not required.

Figure 3:
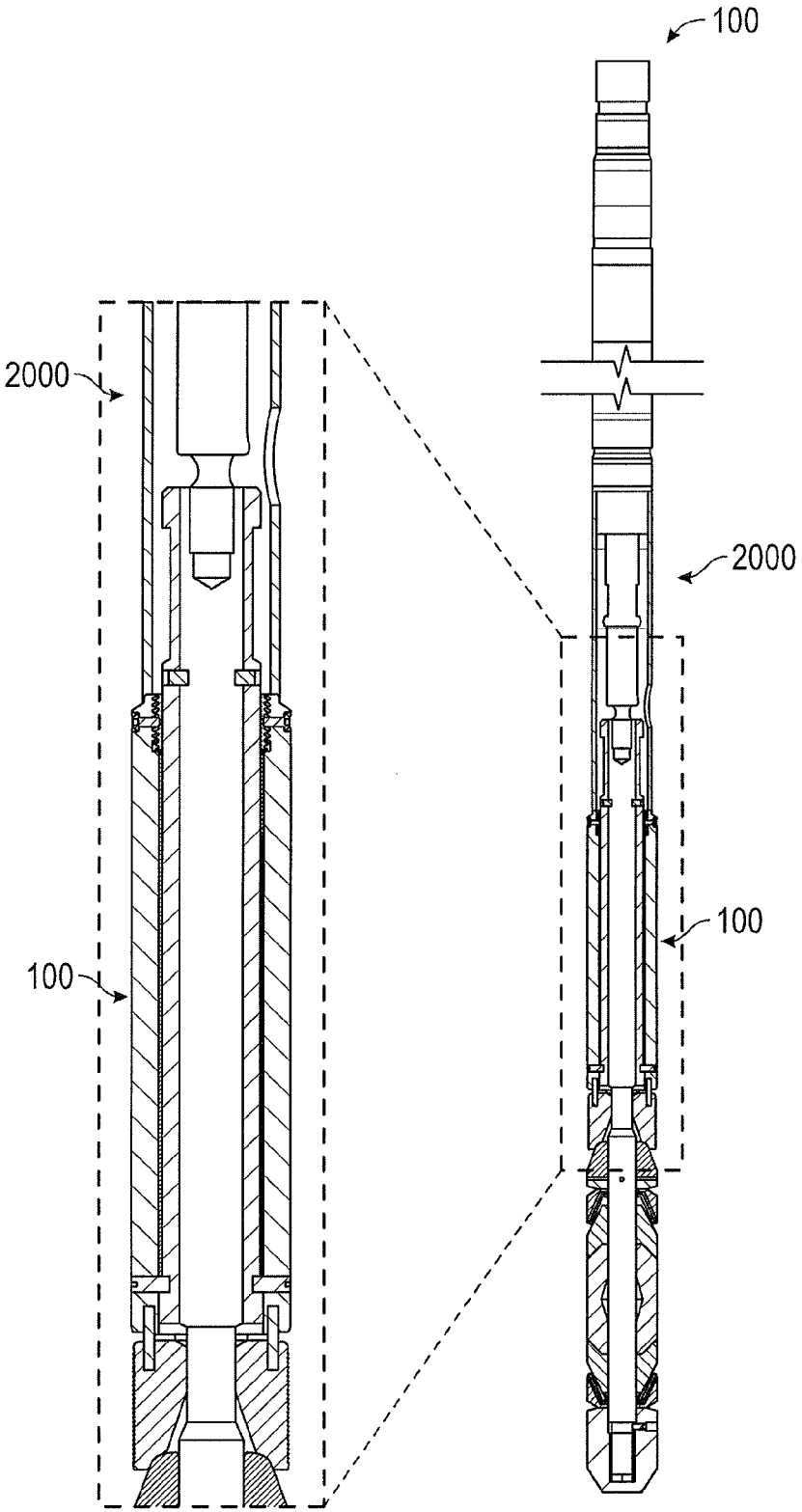
FIG. 3 depicts the tool of FIG. 1 connected to a setting tool string.

FIG. 3 is a schematic illustration of the apparatus 100 of the present disclosure attached to a setting tool 2000.

Because many varying and different embodiments may be made within the scope of the inventive concept herein taught, and because many modifications may be made in the embodiments herein detailed in accordance with the descriptive requirement of the law, it is to be understood that the details herein are to interpreted as illustrative and not in a limiting sense. For instance, the inner mandrel 12 can have a hollow center bore to allow fluid flow through the device (e.g a packing device). In such a case the bottom bull nose preferably will have a threaded axial bore there-through to engage a pipe or tubing string located below the CIBP. For a hollow inner mandrel, the top of the mandrel could terminate in a shear ring that threads onto the exterior of the mandrel 12, instead of the tension stud 1. Another embodiment would place the ratcheting threads in a recess on the inner sleeve (near the end of the sleeve closest to the slip) and threads or ridges positioned on the interior of the outer sleeve 4.

What is claimed is:

1. A downhole plug for use in a well bore, the plug having a run-in configuration, a deployed configuration, and a released configuration, the plug comprising:

a mandrel;

a bull nose having an upwardly facing bearing surface;

a cone and an expandable slip, each concentrically positioned around the mandrel, the cone positioned adjacent to the slip, the expandable slip having an internal surface and an external surface, the external surface containing a gripping surface; the cone having a shaped engagement surface for engaging the expandable slip internal surface; whereby, when the plug is in the deployed configuration, the slip is expanded;

an inner sleeve and an outer sleeve, the outer sleeve positioned concentrically around the inner sleeve and the inner sleeve positioned concentrically around the mandrel, the inner sleeve slidable about the mandrel but releasingly engaged with the mandrel in the run-in configuration and the deployed configuration, the inner sleeve slidable about the outer sleeve but releasingly engaged to the outer sleeve in both the run-in configuration and the deployed configuration and the released configuration, the inner sleeve engaged with the mandrel in the run-in configuration and deployed configuration, the inner sleeve released from the mandrel and slidable about the mandrel in the released configuration; and an elastomeric member disposed about the mandrel between the outer sleeve and the bull nose;

wherein the outer sleeve is configured to be engaged with the expandable slip in the run-in configuration and the outer sleeve is configured to be released from the expandable slip in the deployed configuration and wherein in the released configuration, the releasingly engaged inner and outer sleeves are pulled from the well bore leaving the mandrel, the bull nose, the cone, the expandable slip and the elastomeric member in the well bore.

2. The plug of claim 1 wherein the internal surface of the slip has a tapered portion.

3. The plug of claim 1 wherein the mandrel and the bull nose have a hollow center bore.

4. The plug of claim 1 further comprising a ratcheting mechanism comprising a lock ring that releasingly engages with a series of ridges positioned on either the inner sleeve or the outer sleeve.

5. The plug of claim 1 wherein the inner sleeve is releasingly engaged with the mandrel with a shearable pin or screw.

6. The plug of claim 1 wherein the mandrel and bull nose are integrally formed.

7. The plug of claim 4 wherein the lock ring further comprises a slotted cylinder.

8. The plug of claim 4 wherein the lock ring further comprises a series of independent curved segments.

9. The plug of claim 1, wherein an alignment pin releasably connects the outer sleeve to the expandable slip.

10. A downhole plug for use in a well bore, the plug having a run-in configuration, a deployed configuration, and a released configuration, the plug comprising:

a mandrel;

a bull nose having an upwardly facing bearing surface;

an expandable slip concentrically positioned around the mandrel, the expandable slip having an internal surface and an external surface, the external surface containing a gripping surface; whereby when the plug is in the deployed position, the slip is expanded, and in the run-in configuration, the slip is not expanded;

an inner sleeve and an outer sleeve, the outer sleeve positioned concentrically around the inner sleeve and the inner sleeve positioned concentrically around the mandrel, the inner sleeve slidable about the mandrel but releasingly coupled to the mandrel, the inner sleeve slidable about the outer sleeve but releasingly coupled to the outer sleeve in both the run-in configuration and the deployed configuration, the inner sleeve engaged with the mandrel in the run-in configuration and deployed configuration, the inner sleeve released from the mandrel and slidable about the mandrel in the released configuration;

an elastomeric member disposed about the mandrel between the outer sleeve and the bull nose;

wherein the outer sleeve is configured to be engaged with the expandable slip in the run-in configuration and the outer sleeve is configured to be released from the expandable slip in the deployed configuration and wherein in the released configuration, the releasingly coupled inner and outer sleeves are pulled from the well bore leaving the mandrel, the bull nose, the expandable slip and the elastomeric member in the well bore.

11. The plug of claim 10 further comprising a pin or screw releasingly coupling the inner sleeve and outer sleeve, whereby in the deployed and released configuration, the pin or screw has failed.

12. The plug of claim 10 further comprising a lock ring positioned between the inner and outer sleeve, the lock ring releasingly coupling the inner and outer sleeve in the run-in, deployed and released configurations.

13. The plug of claim 10, wherein an alignment pin releasably connects the outer sleeve to the expandable slip.

14. A method of releasing a portion of a plug that is engaged with a well bore comprising the steps of:

a) providing a plug comprising: a mandrel; a bull nose having an upwardly facing bearing surface; a slip concentrically positioned around the mandrel, the slip having an external surface, the external surface containing a gripping surface, the griping surface engaging a first interior portion of the well bore; an inner sleeve and an outer sleeve, the outer sleeve positioned concentrically around the inner sleeve and the inner sleeve positioned concentrically about the mandrel; the inner sleeve slidable about the mandrel but releasingly engaged to the mandrel; the outer sleeve being slidable but releasingly engaged with the inner sleeve at a first position on the inner sleeve; an elastomeric member positioned concentrically about the mandrel between the outer sleeve and the bearing surface, the elastomeric member engaging a second interior portion of the well bore; wherein the outer sleeve is configured to be releasable engaged with the expandable slip in the run-in configuration and the outer sleeve is configured to be released from the expandable slip in the deployed configuration and wherein in the released configuration, the releasingly engaged inner and outer sleeves are pulled from the well bore leaving the mandrel, the bull nose, the slip and the elastomeric member in the well bore;

b) positioning a tool adjacent to either the mandrel or the inner sleeve, and applying force to the mandrel or the inner sleeve with the tool, whereby the inner sleeve releases from engagement with the mandrel, but the inner sleeve remains engaged with the outer sleeve.

15. The method of claim 14 further comprising the steps of:

c) coupling the tool to the inner sleeve and applying an upward force to the inner sleeve with the tool.

16. The method of claim 14 further comprising the steps of:

c) applying a first downward force to the mandrel with the tool.

17. The method of claim 15 further comprising the steps of:

d) removing the engaged inner and outer sleeves from the mandrel.

18. The method of claim 16 further comprising the steps of:

d) waiting a period of time, after the application of the first downward force, whereby the elastomeric member disengages with the wall of the well bore, and applying a second downward force to either the mandrel, inner sleeve or outer sleeve, whereby the plug descends in the well bore.

19. The method of claim 15 further comprising the steps of:

d) waiting a period of time, after the application of the upward force, whereby the elastomeric member disengages with the wall of the well bore, and applying a downward force to the mandrel.

20. The method of claim 17 further comprising the steps of:

e) after removal of the engaged inner and outer sleeves, milling or drilling the remaining portion of the plug in the well bore.

21. The method of claim 14 wherein the inner sleeve and mandrel are releasingly engaged with a pin or screw.

22. The method of claim 14 wherein the inner and outer sleeve are releasing engaged by a lock ring.

23. The method of claim 22 wherein the lock ring comprises a threadable segment that is positioned between the inner and outer sleeve.

24. The method of claim 23 wherein the lock ring comprises a series of threadable segments.

* * * * *